US009224401B2

(12) United States Patent
Fujita et al.

(10) Patent No.: US 9,224,401 B2
(45) Date of Patent: Dec. 29, 2015

(54) AUDIO SIGNAL ENCODING METHOD AND DEVICE

(75) Inventors: Tomoya Fujita, Sagamihara (JP); Mari Asami, Kawasaki (JP); Jun Ono, Kawasaki (JP)

(73) Assignee: SOCIONEXT INC., Yokohama (JP)

( * ) Notice: Subject to any disclaimer, the term of this patent is extended or adjusted under 35 U.S.C. 154(b) by 653 days.

(21) Appl. No.: 13/562,960

(22) Filed: Jul. 31, 2012

(65) Prior Publication Data

US 2013/0034233 A1 Feb. 7, 2013

(30) Foreign Application Priority Data

Aug. 5, 2011 (JP) ..... 2011-171821

(51) Int. Cl.
*G10L 19/022* (2013.01)
*G10L 19/002* (2013.01)

(52) U.S. Cl.
CPC ..... *G10L 19/022* (2013.01); *G10L 19/002* (2013.01)

(58) Field of Classification Search
CPC . G10L 19/02; G10L 19/0204; G10L 19/0017; G10L 19/0208; G10L 19/0212; G10L 19/24; G10L 19/002; G10L 19/00; G10L 19/022; H04B 1/665; H04B 1/667; H04H 20/89; H04H 20/48; H04S 3/02; G11B 20/10
USPC ..... 704/229, 230, 200.1, E19.001, 704/E19.022; 381/23
See application file for complete search history.

(56) References Cited

U.S. PATENT DOCUMENTS

| | | | | |
|---|---|---|---|---|
| 7,630,902 | B2 * | 12/2009 | You | 704/500 |
| 7,668,715 | B1 * | 2/2010 | Chaugule et al. | 704/230 |
| 8,332,216 | B2 * | 12/2012 | Kurniawati et al. | 704/229 |
| 2003/0115050 | A1 * | 6/2003 | Chen et al. | 704/230 |
| 2010/0169080 | A1 | 7/2010 | Tsuchinaga et al. | |
| 2012/0136657 | A1 * | 5/2012 | Shirakawa et al. | 704/229 |
| 2012/0290306 | A1 * | 11/2012 | Smyth et al. | 704/500 |

FOREIGN PATENT DOCUMENTS

| | | |
|---|---|---|
| JP | 11-219197 | 8/1999 |
| JP | 2001-154695 | 6/2001 |
| JP | 2001-154698 | 6/2001 |
| JP | 2010-156837 | 7/2010 |

OTHER PUBLICATIONS

Noll, MPEG digital audio coding standards—2000); CRC Press LLC.*

* cited by examiner

*Primary Examiner* — Vivian Chin
*Assistant Examiner* — David Ton
(74) *Attorney, Agent, or Firm* — Westerman, Hattori, Daniels & Adrian, LLP

(57) ABSTRACT

An audio signal encoding device includes: a window determination unit for determining the type of window of each channel; a correction unit for correcting the number of available bits; and a quantization unit for quantizing the audio signal of each channel sequentially so that the number of bits is equal to or less than the corrected number of available bits while adding the number of bits left unused, and the correction unit includes: a use rate history calculation unit for calculating a bit use rate in quantization of each type of window; and a corrected bit number calculation unit for correcting the number of available bits so that the rate of used bits to the number of available bits of each channel on the assumption that quantization is performed with the calculated bit use rate in quantization approaches the same.

3 Claims, 6 Drawing Sheets

AUDIO SIGNAL ENCODING METHOD AND DEVICE

CROSS-REFERENCE TO RELATED APPLICATION

This application is based upon and claims the benefit of priority of the prior Japanese Patent Application No. 2011-171821, filed on Aug. 5, 2011, the entire contents of which are incorporated herein by reference.

FIELD

The embodiments discussed herein are related to an audio signal encoding method and an audio signal encoding device.

BACKGROUND

In encoding an audio signal, quantization processing is performed for data compression. Encoding an audio signal is performed by utilizing, for example, a computer. In quantization processing, the quantization scale is corrected so that the spectral information of each channel has bits in the number of available bits or less determined by the bit rate and thus the quantization processing is completed. As a result, in the actual quantization processing, there is a case where the number of bits in quantization is smaller than the number of available bits and some bits are left unused.

On the other hand, as an audio signal, an audio signal capable of obtaining realism, such as stereo and 5.1 channel sound, is used widely, and therefore, each of a plurality of channels is encoded so that the total number of bits after the plurality of channels is encoded is smaller than the total number of available bits. In the encoding of the audio signal in the plurality of channels, effectively using of the bits left unused as described above has been sought. For example, improving the bit use rate in the total number of available bits by adding the bits left unused of the channel encoded previously to the number of available bits of a channel to be encoded later has been attempted.

RELATED DOCUMENTS

[Patent Document 1] Japanese Laid Open Patent Document No. 2010-156837

[Patent Document 2] Japanese Laid Open Patent Document No. H11-219197

[Patent Document 3] Japanese Laid Open Patent Document No. 2001-154695

[Patent Document 4] Japanese Laid Open Patent Document No. 2001-154698

SUMMARY

According to a first aspect of the embodiments, an audio signal encoding method encodes each audio signal of a plurality of channels. The audio signal encoding method includes: calculating perceptual entropy of the audio signal of each channel; allocating a number of available bits to each channel in accordance with the perceptual entropy; correcting the number of available bits; quantizing the audio signal of each channel sequentially so that the number of bits is equal to or less than the corrected number of available bits while adding the number of bits left unused, which is a difference between the number of bits actually used in quantization in the channel already quantized within the frame and the corrected number of available bits; and correcting the number of available bits by calculating a bit use rate in quantization for each type of window based on encoded data in the frames before the frame of target of processing so that the rate to the number of available bits of each channel on the assumption that quantization is performed with the calculated bit use rate in quantization approaches the same.

According to a second aspect of the embodiments, an audio signal encoding device encodes each audio signal of a plurality of channels. The audio signal encoding device includes: a perceptual entropy calculation unit configured to calculate perceptual entropy of the audio signal of each channel; a bit division unit configured to determine a number of available bits of each channel in accordance with the perceptual entropy; a window determination unit configured to determine the type of window of the audio signal of each channel; a correction unit configured to correct the number of available bits, and a quantization unit configured to quantize the audio signal of each channel sequentially so that the number of bits is equal to or less than the corrected number of available bits while adding the number of bits left unused, which is a difference between the number of bits actually used in quantization in the channel already quantized within the frame and the corrected number of available bits, wherein the correction unit includes: a use rate history calculation unit configured to calculate a bit use rate in quantization of each type of window based on the encoded data in the frames before the frame of target of processing; and a corrected bit number calculation unit configured to correct the number of available bits so that the rate of used bits to the number of available bits of each channel on the assumption that quantization is performed with the calculated bit use rate in quantization approaches the same.

The object and advantages of the embodiments will be realized and attained by means of the elements and combination particularly pointed out in the claims.

It is to be understood that both the foregoing general description and the following detailed description are exemplary and explanatory and are not restrictive of the invention.

DESCRIPTION OF EMBODIMENTS

First, the technique that forms a basis of an embodiment to be explained below is explained with reference to drawings.

Figure 1:
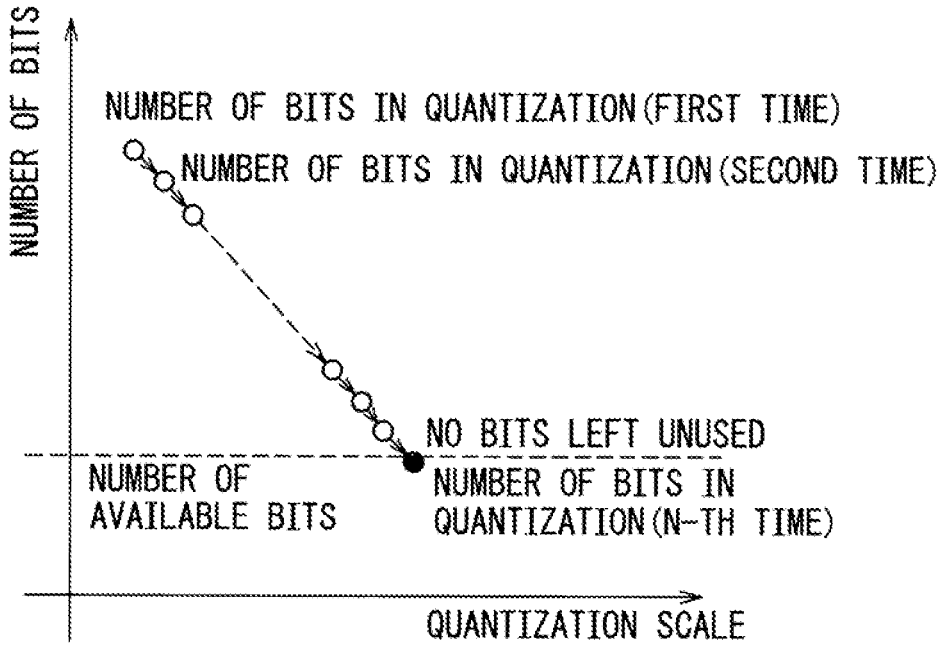
FIG. 1 is a diagram illustrating a change in the number of bits after quantization when quantization processing is performed in an ideal state.

FIG. 1 is a diagram illustrating a change in the number of bits after quantization when quantization processing is performed in an ideal state. As illustrated in FIG. 1, in an ideal state, it is possible to use all of the number of available bits in quantization (hereinafter, also referred to as the number of available bits), in other words, to complete the quantization processing in a state where the number of bits after equalization equals to the number of available bits by setting the number of times of quantization scale correction to infinity and thus completing the quantization processing. However, normally, if the number of times of quantization scale correction is increased, the amount of processing increases and the processing time increases accordingly, and therefore, it is not possible to complete the quantization processing within a predetermined period of time. As a result, it is not possible to perform quantization processing in the ideal state where the number of times of quantization scale correction is infinite, and therefore, the number of times of quantization scale correction is set to a finite number.

Figure 2:
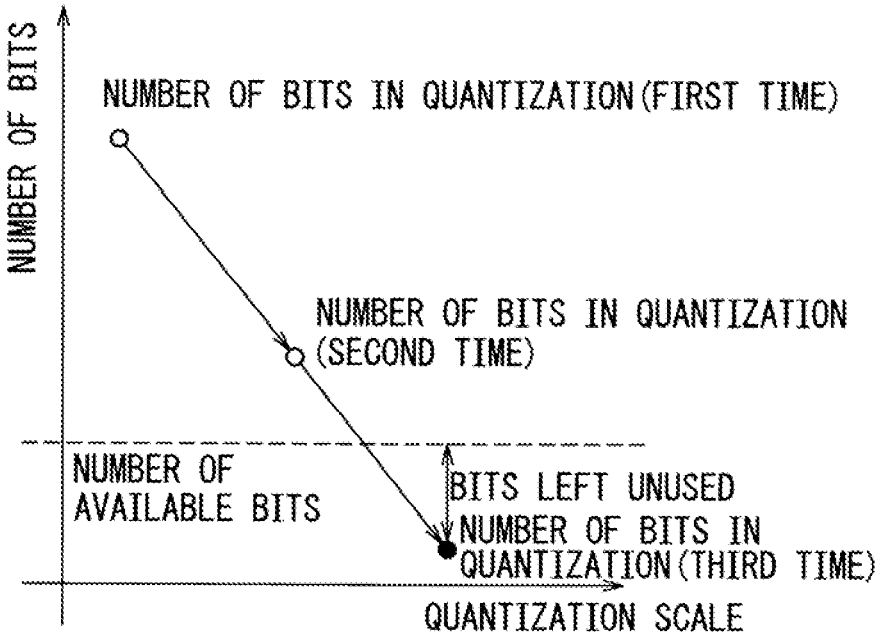
FIG. 2 is a diagram illustrating the change in the number of bits after quantization when the number of times of quantization scale correction is finite.

FIG. 2 is a diagram illustrating the change in the number of bits after quantization when the number of times of quantization scale correction is finite. Because the number of times of quantization scale correction is finite, it is desirable to complete quantization in as early a stage as possible. As a result, intervals of quantization scale correction steps are set large to a certain extent, however, the number of bits in quantization of each channel is in such a relationship that the number of bits in equalization is less than the number of available bits, and therefore, some bits are left unused.

As an audio signal, a stereo audio signal capable of obtaining realism is widely used conventionally, and in recent years, contents of the 5.1 channel sound more excellent surrounding environment than that of the conventional stereo have been increasing in number. When encoding an audio signal in such a plurality of channels, the plurality of channels are individually encoded for each frame and for the total number of bits after encoding the plurality of channels to be smaller than the total number of available bits.

In recent years, the amount of information of digital contents becomes large and the audio signal is also requested to have "high sound quality at a low bit rate". As a result, when encoding an audio signal in a plurality of channels, it is also desirable to achieve high sound quality by making effective use of the bits left unused as described above. Consequently, when sequentially quantizing the audio signals of the plurality of channels so that the number of bits is equal to or less than the number of available bits, the number of bits left unused, which is the difference between the number of bits actually used in quantization of the channel already quantized within a frame and the allocated number of available bits is calculated. Then, the number of bits left unused is added to the number of available bits of the channel to be subjected to encoding processing and then, quantization is performed. For example, in the case of two channels, the total number of bits is divided into a first number of available bits of a first channel and a second number of available bits of a second channel, respectively. Next, the audio signal of the first channel is quantized so that the number of bits is equal to or less than the first number of available bits. In this case, as illustrated in FIG. 2, the number of bits of the quantized audio signal of the first channel is smaller than the first number of available bits, and therefore, some bits are left unused. Next, the audio signal of the second channel is quantized and in this case, the second number of available bits to which the number of bits left unused is added is taken to be a modified second number of available bits and the audio signal of the second channel is quantized so that the number of bits is equal to or less than the modified second number of available bits. In this manner, it is possible to make effective use of the total number of available bits.

Figure 3:
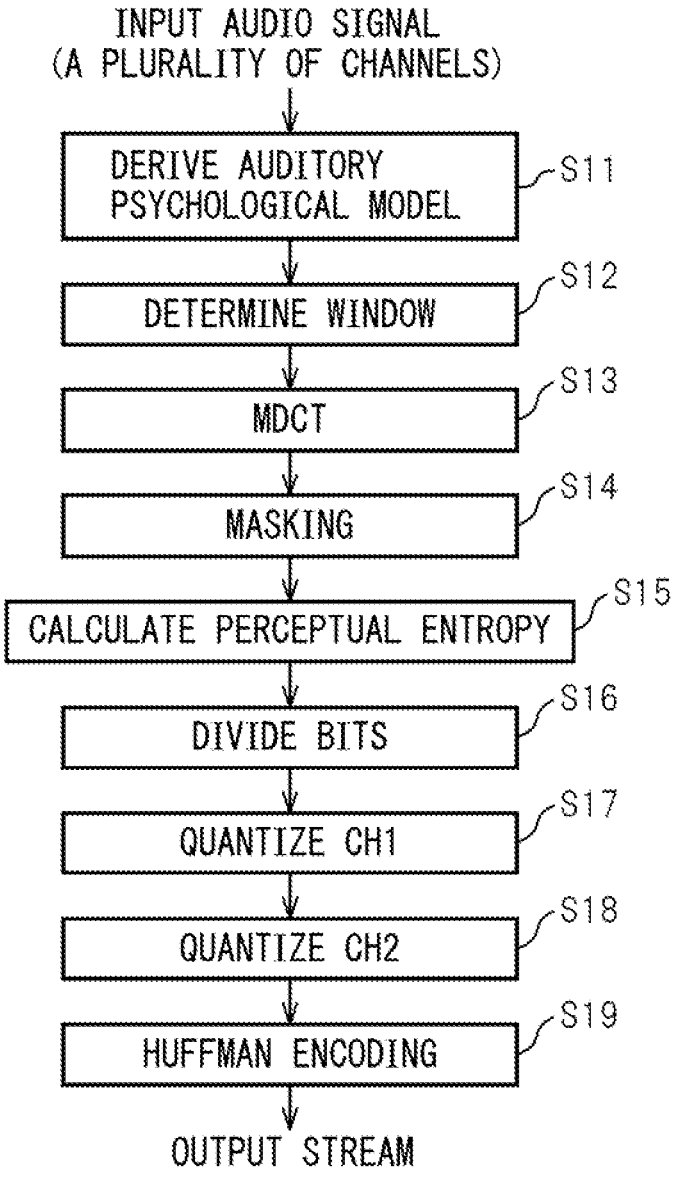
FIG. 3 is a flowchart illustrating processing when the number of bits left unused of the channel already encoded is added to the number of available bits of the channel to be encoded next in the processing to encode the audio signal of a plurality of channels (here, two channels)

FIG. 3 is a flowchart illustrating processing when the number of bits left unused of the channel already encoded is added to the number of available bits of the channel to be encoded next in the processing to encode the audio signal of a plurality of channels (here, two channels).

In step S11, a psychoacoustic model is derived from the input audio signals of the plurality of channels.

In step S12, a short window or a long window is selected.

In step S13, modified discrete cosine transform (MDCT) is performed to transform the input signal from a time region into a frequency region and to divide into a scale factor band in accordance with the frequency resolution of the psychoacoustic model.

In step S14, masking power is derived for each scale factor band by the psychoacoustic model and the MDCT coefficient.

In step S15, perceptual entropy is derived for each channel from the MDCT coefficient and the masking power.

In step S16, the number of available bits is allocated to each channel based on the perceptual entropy.

In step S17, the audio signal of the first channel (CH1) is quantized so that the number of bits is equal to or less than the first number of available bits by performing scheduling processing of each scale factor band. At this time, some bits are left unused.

In step S18, a modified second number of available bits is calculated, which is the second number of available bits of the second channel (CH2) to which the number of bits left unused in step 17 is added. After that, the audio signal of the second channel (CH2) is quantized so that the number of bits is equal to or less than the modified second number of available bits by performing scheduling processing for each scale factor band.

In step S19, the quantized MDCT coefficient is compressed by Huffman encoding.

From the encoded data obtained as above, a stream is generated and output.

In the flowchart in FIG. 3, the processing is widely known except for the processing to add the bits left unused of the first channel already encoded to the number of available bits of the second channel to be encoded next performed in step S18, and therefore, an explanation is omitted.

As described above, when the bits left unused of the first channel encoded previously is added to the number of available bits of the second channel to be encoded later, the number of available bits of the second channel to be quantized later increases and the bit use rate in the total number of available bits is improved. However, the bit use rate is improved only in the second channel to be encoded later, and therefore, there arises a difference in sound quality between channels and the balance of sound quality between channels deteriorates.

Figure 4:
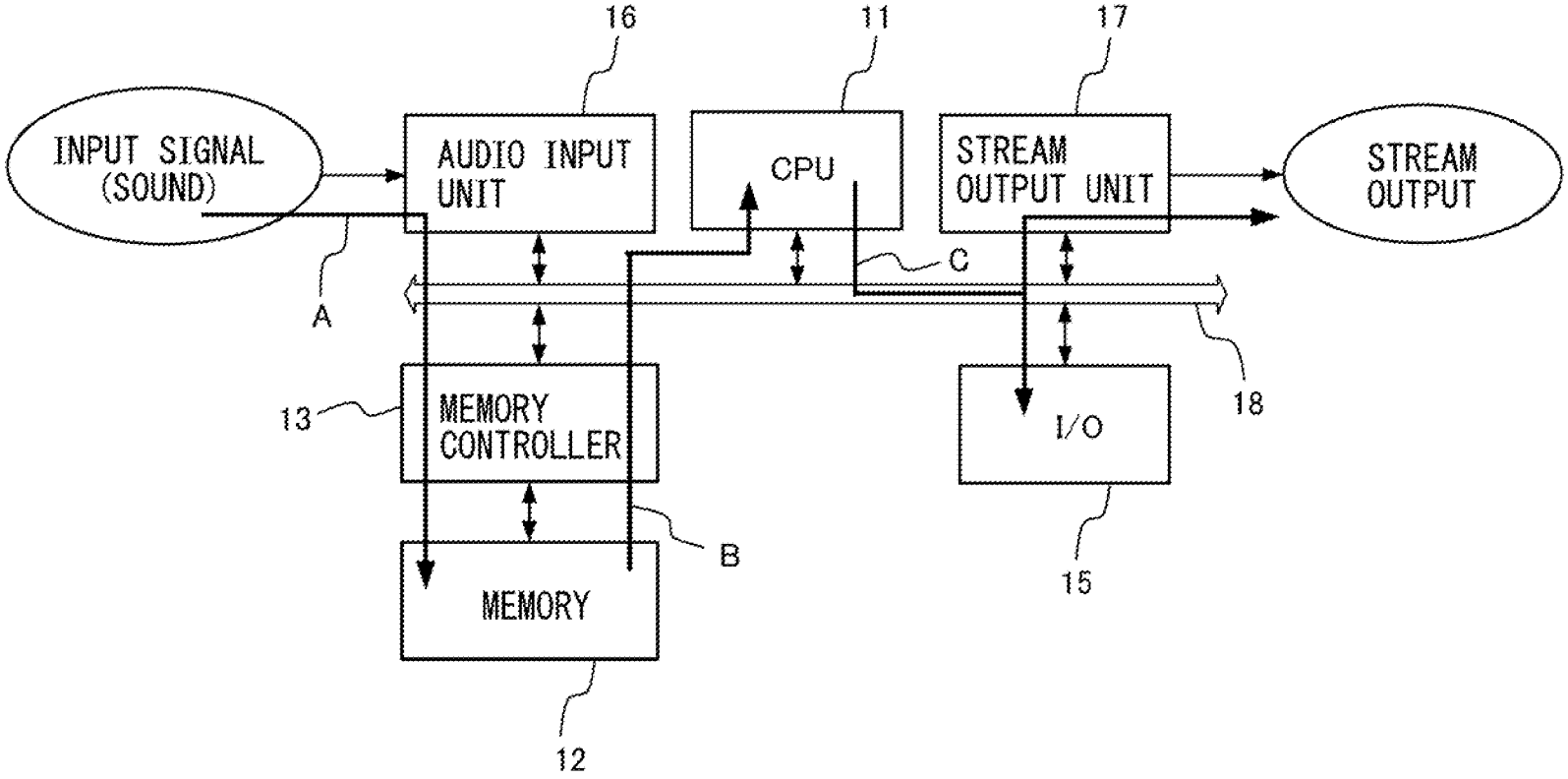
FIG. 4 is a diagram illustrating an example of a hardware configuration of a multichannel audio signal encoding device (hereinafter, abbreviated to encoding device) of the embodiment.

FIG. 4 is a diagram illustrating an example of a hardware configuration of a multichannel audio signal encoding device (hereinafter, abbreviated to encoding device) of the embodiment.

As illustrated in FIG. 4, the encoding device of the embodiment has a CPU (Central Processing Unit) 11, a memory 12, a memory controller 13, an I/O port (Input/Output Port) 15, an audio signal input unit 16, and a stream output unit 17. The audio signal input unit 16 takes in an audio input signal (sound) into the inside of the system from outside and when the input audio signal is an analog signal, generates digital data by performing A/D conversion at a predetermined sampling frequency. Explanation is made based on the assumption that the audio input signal is digital data. The memory controller 13 controls read and write from and to the memory 12 in accordance with a request of a hardware component, such as the CPU 11. The CPU 11 controls the whole of the device, performs encoding processing on input data, and generates a stream. The I/O port 15 is an interface with an external device, such as a USB (Universal Serial Bus) and SD. The stream output unit 17 outputs a generated stream.

In FIG. 4, reference symbols A to C represent a flow of signal/data in processing. As represented by A, audio input data, which is the target of processing, is taken into the inside of the device by the audio signal input unit 16 and saved in the memory 12 via the memory controller 13. As represented by B, the CPU 11 loads the audio input data on the memory 12 into the inside thereof via the memory controller 13 and performs encoding processing. The CPU 11 stores the bit use rate obtained as a result of the encoding processing in the memory 12 via the memory controller 13 and manages for each type of window. As represented by C, the encoded audio output data is output to the stream output unit 17 or to an external device via the I/O port 15.

The hardware configuration illustrated in FIG. 4 is a configuration used widely in audio signal processing, and therefore, more explanation is omitted. The hardware configuration of the encoding device of the embodiment is not limited to the configuration in FIG. 4.

Figure 5:
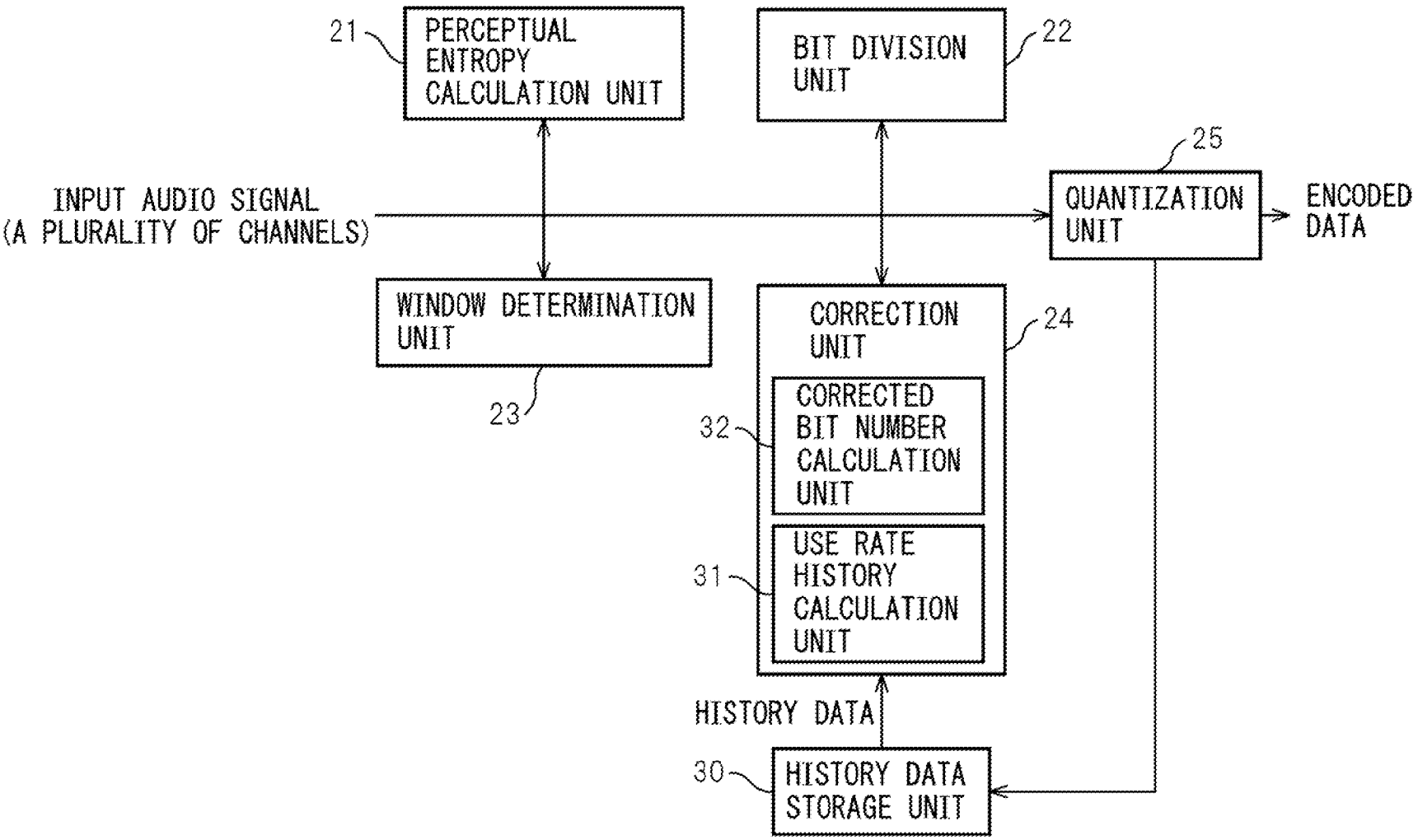
FIG. 5 is a processing block diagram of the encoding device of the embodiment having the hardware configuration illustrated in FIG. 4.

FIG. 5 is a processing block diagram of the encoding device of the embodiment having the hardware configuration illustrated in FIG. 4.

The encoding device of the present embodiment encodes the audio signal of each of the plurality of channels so that the total number of bits within a frame is equal to or less than an upper limit number of bits. As illustrated in FIG. 5, the encoding device of the embodiment has a perceptual entropy calculation unit 21, a bit division unit 22, a window determination unit 23, a correction unit 24, a quantization unit 25, and a history data storage unit 30. The correction unit 24 has a use rate history calculation unit 31 and a corrected bit number calculation unit 32.

The perceptual entropy calculation unit 21 calculates perceptual entropy of the audio signal of each channel. The bit division unit 22 determines the number of available bits of each channel in accordance with the perceptual entropy. The window determination unit 23 determines the window type, such as whether the window of the audio signal of each channel is the short window or the long window. For example, the window determination unit 23 selects the short window when the audio signal is a transient signal and selects the long window when the audio signal is a stationary signal. The quantization unit 25 sequentially quantizes the audio signal of each channel so that the number of bits is equal to or less than the number of available bits and performs quantization while sequentially adding the number of bits left unused, which is the difference between the number of bits actually used in quantization of the channel already quantized within the frame and the number of available bits, to the number of available bits of the subsequent channel. The history data storage unit 30 stores the bit use rate for each channel obtained as a result of the quantization processing by the quantization unit 25.

The correction unit 24 corrects the number of available bits of each channel determined by the bit division unit 22. In the algorithm of correction, the bit average use rate in quantization for the past (N−1) frames is found for each piece of window information (type). By using the bit average use rate in quantization, the number of bits left unused of the channel to be quantized earlier (CH1 in the case of FIG. 6, to be described later) is added to the number of bits available for quantization of the channel to be quantized later (CH2 in the case of FIG. 6, to be described later). Then, the corrected number of bits is calculated so that the bit use rate in quantization is the same in all the channels for the number of available bits at the time of bit division when addition is made and quantization is performed with the same bit use rate as the past bit average use rate in quantization.

The use rate history calculation unit 31 calculates, for each window type, an actual average value of the bit use rate in quantization from the bit use rates of the frames before the frame of the target of processing stored in the history data storage unit 30. The corrected bit number calculation unit 32 calculates the corrected number of bits so that the estimated use rates for the number of available bits of each channel are the same when it is assumed that quantization is performed with the bit use rate in quantization, which is the calculated actual average value, and corrects the number of available bits by adding the corrected number of bits that is calculated to the number of available bits of each channel. Due to this, it is possible to improve the bit use rate for the number of bits allocated to each channel. Further, it is also possible to bring the bit use rates close to each other in quantization for the number of available bits allocated to each channel to each other, and therefore, it is possible to eliminate the difference in sound quality between channels.

The bit use rate that the history data storage unit 30 stores is not the bit use rate in quantization for the number of bits allocated to each channel but the bit use rate for the corrected number of available bits.

Figure 6:
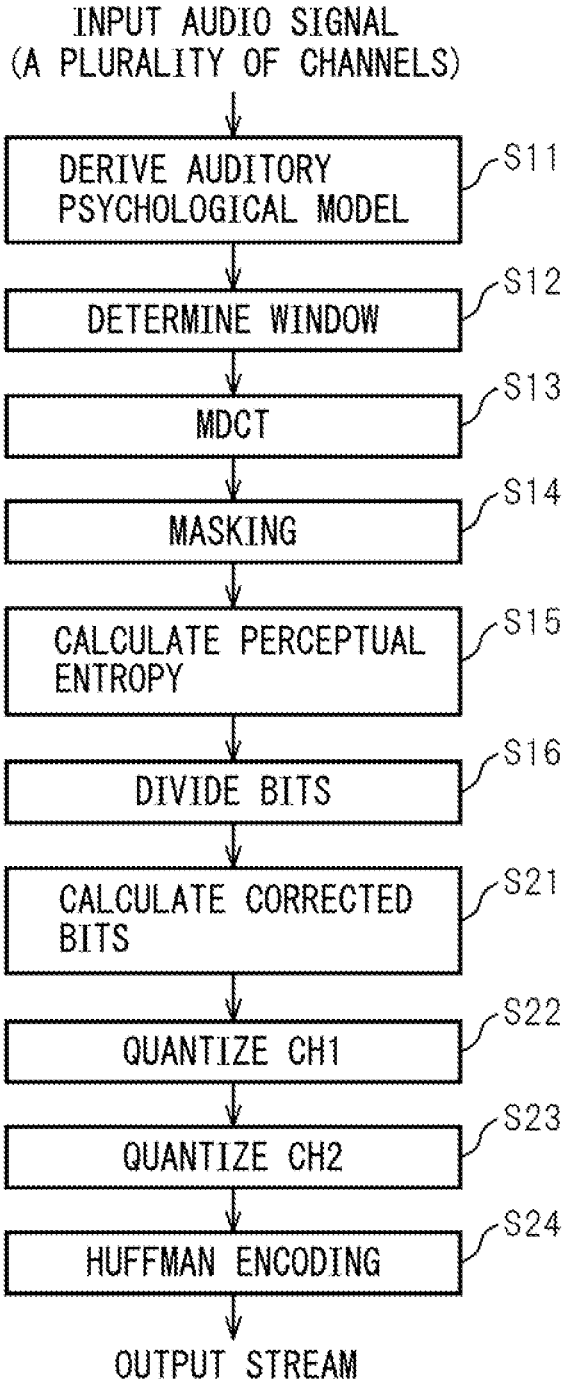
FIG. 6 is a flowchart illustrating the processing to encode an audio signal in a plurality of channels (here, two channels) in the encoding device of the embodiment.

FIG. 6 is a flowchart illustrating the processing to encode an audio signal in a plurality of channels (here, two channels) in the encoding device of the embodiment.

From steps S11 to S16 are the same as those in the case of the flowchart explained in FIG. 3, and therefore, explanation is omitted.

In step S21, the correction unit 24 corrects the number of available bits of each channel determined by the bit division unit 22.

Steps S22 to S24 are the same as S17 to S19 of the flowchart explained in FIG. 3 except in that processing is performed on the corrected number of available bits, and therefore, explanation is omitted.

Figure 7:
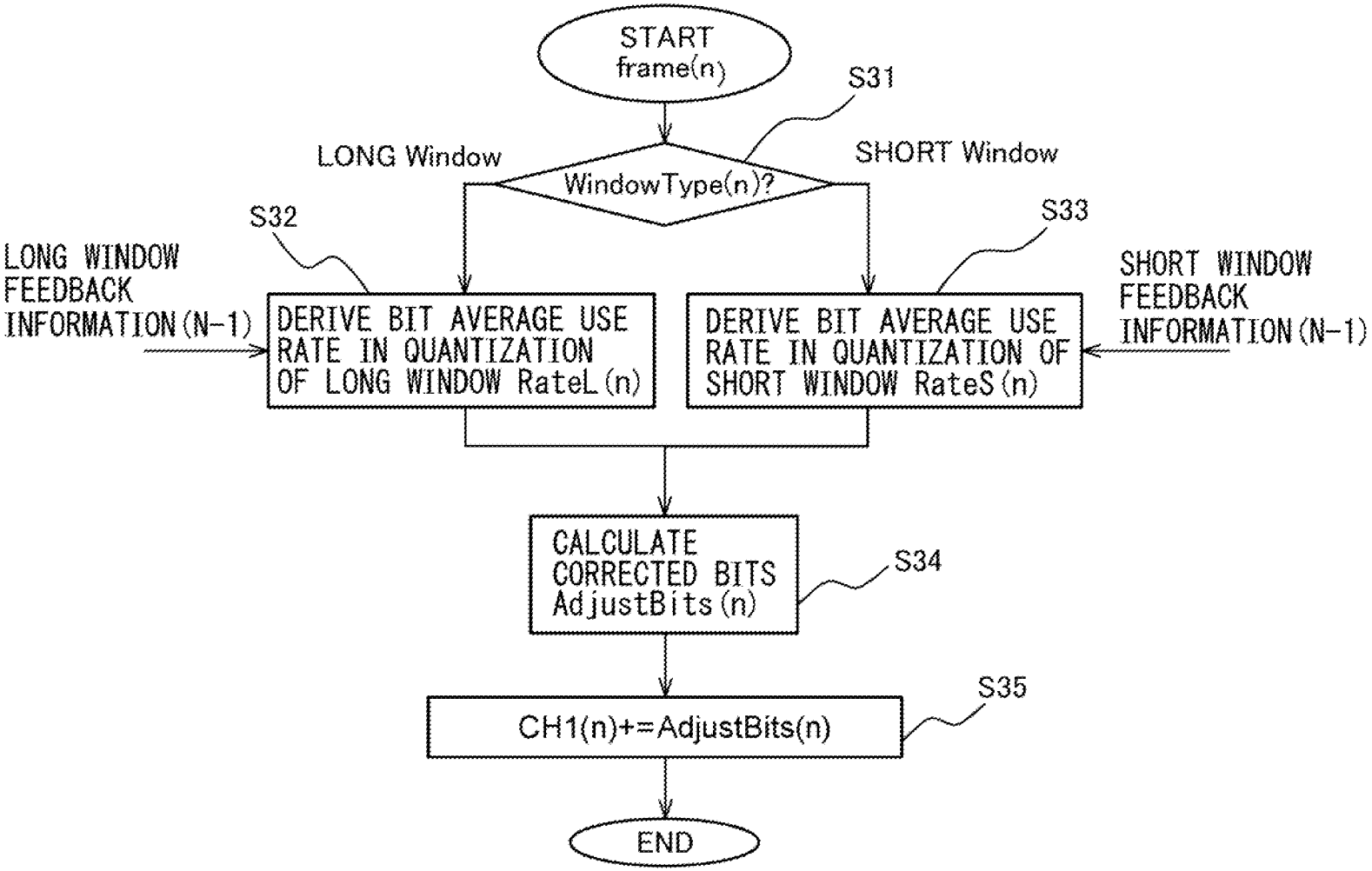
FIG. 7 is a flowchart illustrating corrected bit number calculation processing in the corrected bit number calculation unit 32, illustrating an example of a case where there are two channels, CH1 and CH2.

FIG. 7 is a flowchart illustrating corrected bit number calculation processing in the corrected bit number calculation unit 32, illustrating an example of a case where there are two channels, CH1 and CH2.

The current frame number is represented by n, the number of available bits allocated to each channel by bit division processing of the current frame is represented by CH1(n) and CH2(n), and the bit use rates in quantization of the long window and the short window are represented by RateL(n) and RateS(n), respectively. The window information of each channel is assumed to be CH1=LONG and CH2=SHORT.

In step S31, when the long window is indicated by the window information of the current frame, the procedure proceeds to step S32 and when the short window is indicated, the procedure proceeds to step S33.

In step S32, the bit average use rate in quantization RateL (n) of the long window in the feedback information of the past frames 0 to n−1 is derived by Equation (1) and then the procedure proceeds to step S34.

$$RateL(n) = \frac{\sum_{N=1}^{n-1} RateL(N)}{n-1} \quad (1)$$

In step S33, the bit average use rate in quantization RateS (n) of the short window in the feedback information of the past frames 0 to n−1 is derived by Equation (2) and the procedure proceeds to step S34

$$RateS(n) = \frac{\sum_{N=1}^{n-1} RateS(N)}{n-1} \quad (2)$$

In step S34, the corrected number of bits is calculated for each channel. Here, CH1=LONG and CH2=SHORT, and therefore, if the bit use rates in quantization of the first and second channels are taken to be RateCH1(n) and RateCH2 (n), it is possible to estimate as follows:

$$\text{Rate}CH1(n)=\text{Rate}L(n)$$

$$\text{Rate}CH2(n)=\text{Rate}S(n).$$

In the case where the corrected number of bits AdjustBits (n) is taken into consideration, it is assumed that quantization is performed with the bit use rates in quantization RateCH1 (n) and RateCH2(n) in the first and second channels. Then, under this assumption, the bit use rates for the number of available bits at the time of bit division to each channel are taken to be CH1x and CH2x and these are found in accordance with Equations (3) and (4).

$$CH1x = \frac{(CH1(n) + AdjustBits(n)) * RateCH1(n)}{CH1(n)} \quad (3)$$

$$CH2x = \frac{\left\{ \begin{array}{c} (CH2(n) - AdjustBits(n)) + \\ ((CH1(n) + AdjustBits(n)) * (1 - RateCH1(n))) \end{array} \right\} * RateCH2(n)}{CH2(n)} \quad (4)$$

It is assumed that CH1x=CH2x in Equations (3) and (4) and Equations are solved for the corrected number of bits AdjustBis(n), then, Equation (5) is obtained.

$$AdjustBits(n) = \frac{(CH1(n) * CH2(n) * (RateCH2(n) - RateCH1(n))) + (CH1(n)^2 * RateCH2(n) * (1 - RateCH1(n)))}{RateCH1(n) * (CH1(n) * RateCH2(n) + CH2(n))} \quad (5)$$

Equation (5) represents the corrected number of bits AdjustBits(n) to cause CH1x=CH2x to hold.

In step S35, the corrected number of bits AdjustBits(n) that is calculated is added to (subtracted from, if negative) the number of available bits at the time of bit division to each channel.

A specific example for calculating the corrected number of bits by the method described above is explained below.

Example 1

When the Bit Average Use Rates in Quantization of Two Channels (CH1, CH2) are Equal It is assumed that CH1 is the long window, CH2 is the short window, the bit use rate in quantization of the long window and the short window is 0.8, the number of available bits for both channels is 2,000 bits, the bit division ratio by perceptual entropy is CH1:CH2=1:3, and quantization processing is performed in CH1 first then in CH2. The bit use rate is a rate of the number of bits used in the quantization unit to the number of available bits at the time of bit division.

First, a case where correction is not performed is explained.

Bits are divided in the bit division ratio of CH1:CH2=1:3, and therefore, 500 bits are allocated to CH1 and 1,500 bits to CH2. Quantization is performed in CH1 and the bit use rate is 0.8, and therefore, 400 bits are used and 100 bits are left unused. The 100 bits left unused are added to CH2 and 1,600 bits are allocated to CH2. The bit use rate of CH2 is also 0.8, and therefore, 1,600×0.8=1,280 bits are used and 320 bits are left unused. At first, 1,500 bits are allocated to CH2, and therefore, the bit use rate of CH2 is 1,280/1,500=0.85. The number of bits used actually in CH1 and CH2 is 400+1,280=1,680 bits.

Consequently, the number of available bits and the bit use rate of each channel when correction is not performed are in Table 1.

TABLE 1

Bit use rate in quantization (before correction)

| | CH1 | CH2 |
|---|---|---|
| Number of available bits [bit] | 500 | 1500 |
| Bit use rate [%] | 80 | 85 |

Next, a case where correction is performed as in the embodiment is explained.

Similar to the above, bits are divided in the bit division ratio of CH1:CH2=1:3, and therefore, 500 bits are allocated to CH1 and 1,500 bits to CH2. Next, the bit use rate in the previous frames is 0.8 for both the long window and the short window. Consequently, Equation (5) is solved as follows:

$$(500*1,500(0.8-0.8)+500*500*0.8*(1-0.8))/(0.8*(1,500+500*0.8))=26.32$$

Consequently, the corrected number of bits is 26 and the number of allocated bits of CH1 after the correction is 526 and the number of allocated bits of CH2 after the correction is 1,474. The bit use rate is 0.8, and therefore, in CH1, 526×0.8=420 bits are used and 106 bits are left unused. The bit use rate of the used bits to the 500 bits allocated at first is 84%. The 106 bits left unused are added to CH2, and therefore, 1,580 bits are allocated to CH2. Because the bit use rate is 0.8, 1,580×0.8=1,264 bits are used in CH2 and the bit use rate to the 1,500 bits allocated at first is 0.84 (84%). The number of bits actually used in CH1 and CH2 is 420+1,264=1,684 bits.

Consequently, the number of available bits and the bit use rate of each channel when the correction is performed are as those in Table 2.

TABLE 2

Bit use rate in quantization (after correction)

| | CH1 | CH2 |
|---|---|---|
| Number of available bits [bit] | 500 | 1500 |
| Corrected bits [bit] | 26 | −26 |
| Number of bits after correction [bit] | 526 | 1474 |
| Bit use rate after correction [%] | 84 | 84 |

As above, after the correction, there is no difference in the bit use rate between CH1 and CH2, and therefore, it is possible to maintain the balance of sound quality between channels.

Example 2

When the Bit Average Use Rates in Quantization of Two Channels (CH1, CH2) are not Equal It is assumed that CH1 is the short window, CH2 is the long window, the bit use rate in quantization of the short window is 0.9, the bit use rate in quantization of the long window is 0.6, the number of available bits for both channels is 3,000 bits, the bit division ratio by perceptual entropy is CH1:CH2=3:1, and quantization is performed in CH1 first then in CH2.

First, a case where correction is not performed is explained.

Because bits are divided in the bit division ratio of CH1:CH2=3:1, 2,250 bits are allocated to CH1 and 750 bits to CH2. Then, quantization is performed in CH1 and the bit use rate of the short window is 0.9, and therefore, 2,025 bits are used and 225 bits are left unused. The 225 bits left unused are added to CH2 and as a result, 975 bits are allocated to CH2. The bit use rate of CH2 of the long window is 0.6, and therefore, 975×0.6=585 bits are used and 390 bits are left unused. At first, 750 bits are allocated to CH2, and therefore, the bit use rate of CH2 is 585/750=0.78.

Consequently, the number of available bits and the bit use rate of each channel when correction is not performed are as those in Table 3.

TABLE 3

| Bit use rate in quantization (before correction) | | |
|---|---|---|
| | CH1 | CH2 |
| Number of available bits [bit] | 2250 | 750 |
| Bit use rate [%] | 90 | 78 |

Consequently, the bit use rate of CH1 is 0.9 while the bit use rate of CH2 is 0.78, and therefore there arise a difference in the bit use rate and the balance of sound quality between channels deteriorates.

Next, a case is explained where correction is performed as in the embodiment.

Similar to the above, because bits are allocated in the bit division ratio of CH1:CH2=3:1, 2,250 bits are allocated to CH1 and 750 bits to CH2. Next, the bit use rate of the long window is 0.6 and that of the short window is 0.9. Consequently, Equation 5 is solved as follows:

$$(2{,}250*750(0.6-0.9)+2{,}250*2{,}250*0.6*(1-0.9))/(0.9*(750+2{,}250*0.6))=-107.14$$

Consequently, the corrected number of bits is −107, and therefore, the number of allocated bits of CH1 after the correction is 2,143 and the number of allocated bits of CH2 after the correction is 857. Because the bit use rate in CH1 is 0.9, 2,143×0.9=1,929 bits are used and 214 bits are left unused. As a result, the bit use rate to the 2,250 bits allocated at first is 86%. The 214 bits left unused are added to CH2 and therefore 1,071 bits are allocated to CH2. The bit use rate is 0.6, and therefore, in CH2, 1,071×0.6=642 bits are used and the bit use rate to the 750 bits allocated at first is 0.86 (86%).

Consequently, the number of available bits and the bit use rate of each channel when the correction is performed are as those in Table 4.

TABLE 4

| Bit use rate in quantization (after correction) | | |
|---|---|---|
| | CH1 | CH2 |
| Number of available bits [bit] | 2250 | 750 |
| Corrected bits [bit] | −107 | 107 |
| Number of bits after correction [bit] | 2143 | 857 |
| Bit use rate after correction [%] | 86 | 86 |

As above, after the correction, there is no longer a difference in the bit use rate between CH1 and CH2 and it is possible to maintain the balance of sound quality between channels.

Example 3

When the Bit Average Use Rates in Quantization of Three Channels (CH1, CH2, CH3) are not Equal It is assumed that CH1 is the long window, CH2 is the short windows, CH3 is the long window, the bit use rate in quantization of the short window is 0.6, the bit use rate in quantization of the long window is 0.9, the number of available bits for the three channels is 3,000, the bit division ratio by perceptual entropy is CH1:CH2:CH3=1:3:2, and quantization processing is performed in order of CH1, CH2, and CH3.

First, a case is explained where correction is not made.

Because bits are divided in the bit division ratio of CH1:CH2:CH3=1:3:2, 500 bits are allocated to CH1, 1,500 bits to CH2, and 1,000 bits to CH3. Then, quantization is performed in CH1 and the bit use rate of CH1 of the long window is 0.9, and therefore, 450 bits are used and 50 bits are left unused. The 50 bits left unused are added to CH2 and as a result, 1,550 bits are allocated to CH2. Because the bit use rate of CH2 of the short window is 0.6, 1,550×0.6=930 bits are used and 620 bits are left unused. The 620 bits left unused are added to CH3 and as a result, 1,620 bits are allocated to CH3. Because the bit use rate of CH3 of the long window is 0.9, 1,620×0.9=1,458 bits are used. At first, 500 bits are allocated to CH1, 1,500 bits to CH2, and 1,000 bits to CH3, and therefore, the bit use rates of CH1 to CH3 are 0.9, 0.62, and 1.46.

Consequently, the number of available bits and the bit use rate of each channel when correction is not performed are as those in Table 5.

TABLE 5

| Bit use rate in quantization (before correction) | | | |
|---|---|---|---|
| | CH1 | CH2 | CH3 |
| Number of available bits [bit] | 500 | 1500 | 1000 |
| Bit use rate [%] | 90 | 62 | 146 |

Consequently, there arises a difference in the bit use rate between CH1 to CH3 and the balance of sound quality between channels deteriorates.

Next, a case where correction is performed as in the embodiment is explained.

Similar to the above, bits are divided in the bit division ratio of CH1:CH2:CH3=1:3:2, and therefore, 500 bits are allocated to CH1, 1,500 bits to CH2, and 1,000 bits to CH3. Next, the bit use rate of the long window is 0.9 and that of the short window is 0.6. Because there are three channels, Equation (5) is not available and the corrected number of bits is found as follows.

First, it is assumed that the numbers of available bits for CH1 to CH3 are C1 to C3 and the bit use rates in quantization are R1 to R3, respectively, then, corrected numbers of bits A1 to A3 to be added to each channel are found by Equation (6) to Equation (8)

wherein $$A_1 = -\frac{TMP_1 + C_1(-R_2(C_1(1-R_1)+C_2)+C_2R_1)}{C_1R_1R_2+C_2R_1} - TMP_2 \quad (6)$$

wherein $$TMP_1 = -\frac{(-C_1R_2(1-R_1)+C_2R_1)\begin{pmatrix} C_1C_2R_2R_3 - C_1C_2R_3 - C_1C_3R_2R_3 + \\ C_1C_3R_2 + C_2C_3R_2 - C_2C_3R_3 + \\ R_2R_3C_2^2 - R_3C_2^2 \end{pmatrix}}{C_1R_2R_3+C_2R_2R_3+C_3R_2}$$

$$TMP_2 = \frac{C_1C_2R_2R_3 - C_1C_2R_3 - C_1C_3R_2R_3 + C_1C_3R_2 + C_2C_3R_2 - C_2C_3R_3 + R_2R_3C_2^2 - R_3C_2^2}{C_1R_2R_3+C_2R_2R_3+C_3R_2}$$

$$A_2 = -\frac{-TMP_1 + C_1(-R_2(C_1(1-R_1)+C_2)+C_2R_1)}{C_1R_1R_2+C_2R_1} \quad (7)$$

$$A_3 = -\frac{C_1C_2R_2R_3 - C_1C_2R_3 - C_1C_3R_2R_3 + C_1C_3R_2 - C_2C_3R_3 + R_2R_3C_2^2 - R_3C_2^2}{C_1R_2R_3+C_2R_2R_3+C_3R_2} \quad (8)$$

Explanation of the intermediate processing of calculation is omitted.

The number of available bits and the bit use rate of each channel when the correction is performed are as those in Table 6.

TABLE 6

| Bit use rate in quantization (after correction) | | | |
|---|---|---|---|
| | CH1 | CH2 | CH3 |
| Number of available bits [bit] | 500 | 1500 | 1000 |
| Corrected bits [bit] | 35 | 857 | −893 |
| Number of bits after correction [bit] | 535 | 2410 | 1071 |
| Bit use rate after correction [%] | 96 | 96 | 96 |

As described above, after the correction, there is no difference in the bit use rate between CH1 to CH3, and therefore, it is possible to maintain the balance of sound quality between channels.

As described above, the bit use rate is improved only in the second and subsequent channels to be encoded later, and therefor, there arises a difference in sound quality between channels. According to an embodiment, there are realized a method and a device for encoding an audio signal of a plurality of channels capable of improving the sound quality while maintaining the balance of sound quality between channels.

All examples and conditional language provided herein are intended for pedagogical purposes of aiding the reader in understanding the invention and the concepts contributed by the inventor to furthering the art, and are to be construed as limitations to such specifically recited examples and conditions, nor does the organization of such examples in the specification relate to a illustrating of the superiority and inferiority of the invention. Although one or more embodiments of the present invention have been described in detail, it should be understood that the various changes, substitutions, and alterations could be made hereto without departing from the spirit and scope of the invention.

What is claimed is:

1. An audio signal encoding method for encoding each audio signal of a plurality of channels including:

calculating perceptual entropy of the audio signal of each channel;

allocating a number of available bits to each channel in accordance with the perceptual entropy;

correcting the number of available bits;

quantizing the audio signal of each channel sequentially so that the number of bits is equal to or less than the corrected number of available bits while adding the number of bits left unused, which is a difference between the number of bits actually used in quantization in the channel already quantized within the frame and the corrected number of available bits;

in the correcting the number of available bits, calculating a bit use rate in quantization for each type of window based on encoded data in frames preceding a frame of target of processing so that a rate to the number of available bits of each channel on the assumption that quantization is performed with the calculated bit use rate in quantization approaches the same for balancing sound quality between channels;

encoding the quantized audio stream by Huffman encoding; and outputting the encoded stream.

2. An audio signal encoding device for encoding each audio signal of a plurality of channels comprising:

a memory device; and a processor, and wherein the processor carries out processes including:

calculating perceptual entropy of the audio signal of each channel;

allocating a number of available bits to each channel in accordance with the perceptual entropy;

correcting the number of available bits;

quantizing the audio signal of each channel sequentially so that the number of bits is equal to or less than the corrected number of available bits while adding the number of bits left unused, which is a difference between the number of bits actually used in quantization in the channel already quantized within the frame and the corrected number of available bits;

in the correcting the number of available bits, calculating a bit use rate in quantization for each type of window based on encoded data in frames preceding a frame of target of processing so that a rate to the number of available bits of each channel on the assumption that quantization is performed with the calculated bit use rate in quantization approaches the same for balancing sound quality between channels;

encoding the quantized audio stream by Huffman encoding; and outputting the encoded stream; and wherein the memory stores encoded data including the bit use rate in quantization of each type output by the quantizing.

3. The audio signal encoding device according to claim 2, wherein the processor calculates the bit use rate in quantization of each type of window based on the encoded data in the frames preceding to the frame of target of processing stored in the memory device.

* * * * *